United States Patent [19]

Doyle

[11] 4,191,443

[45] Mar. 4, 1980

[54] ELECTRICAL CONNECTOR MEANS

[75] Inventor: Richard C. Doyle, Greenlawn, N.Y.

[73] Assignee: Slater Electric Inc., Glen Cove, N.Y.

[21] Appl. No.: 820,038

[22] Filed: Jul. 28, 1977

[51] Int. Cl.[2] ..... H01R 13/58

[52] U.S. Cl. ..... 339/103 R; 339/196 M

[58] Field of Search ..... 339/101, 103, 196, 209, 339/14

[56] References Cited

U.S. PATENT DOCUMENTS 4,053,198 10/1977 Doyle et al. ..... 339/103 R

*Primary Examiner*—Joseph H. McGlynn

*Attorney, Agent, or Firm*—Morgan, Finnegan, Pine, Foley & Lee

[57] ABSTRACT

An electrical connector assembly for coupling the end of one electrically conductive cable to another includes a connector front formed with a pair of oppositely disposed legs extending rearwardly from its front face, a terminal housing releasably lockably engageable by projections on the legs to form a connector body with electrical contacts therebetween and a connector housing releasably lockably engageable by a latching sear on the end of each leg for coupling the connector body to the connector housing. In addition, a collar member is threaded onto the other end of the connector housing with a chuck member positioned therebetween for tighteningly grasping the cable. Advantageously, the chuck member includes extensions adapted to be positioned behind each sear for preventing inadvertent disassembly of the connector body from the connector housing. Also advantageously, the terminal housing is formed with a slot extending radially outwardly from the center thereof, with one projecting surface adapted to abut the radially inward surface of the head of an elongate ground terminal screw and another projecting surface adapted to abut the radially outward surface of a flange formed on the grounding screw for retaining the ground screw which is threaded into a contact plate for moving toward another contact plate adapted to bear against a flange on the screw to enable termination of the ground conductor by inserting it into the spacing between contact plates and tightening the plates together by threading the grounding screw.

24 Claims, 12 Drawing Figures

ELECTRICAL CONNECTOR MEANS

BACKGROUND AND OBJECTS OF THE INVENTION

The present invention relates generally to connector means and, more particularly, to electrical connector means known commercially as "electrical caps and connectors". In addition, it will be understood the description of the invention, contained herein, will be equally applicable to plug connector means (the cable "cap") as well as to receptacle connector means (the cable "connector").

The art is replete with connector devices for coupling the ends of a pair of electrical cables. In virtually all of these devices component parts have been secured together in assembled unit(s) by metallic threaded fasteners - e.g. for fastening the terminal housing to the connector front to form the connector body and/or for fastening the connector body to the connector housing (outer casing). Such structures, however, suffer several disadvantages. Numerous small fastening screws are needed to complete installation, requiring small tools, inconveniencing the electrician and adding to fabrication costs. Furthermore, the metallic fasteners are often installed on the surfaces of connector bodies which are to face each other when plugged together. The proximity of these metallic parts always gives rise to the potential danger of a short circuit.

In addition, cap and connector apparatus heretofore known have generally necessitated fabrication in more than one size in order that most multi-conductor cables, particularly for four-and five-conductor cables may be fitted with these devices. Thus, significant additional fabrication expenses and efforts are required.

Furthermore, in connector devices having a ground terminal/contact located centrally of the connector front, it has been the practice to wire the ground conductor of the cable to the ground terminal by wrapping the conductor around a centrally located screw (i.e., by binding screw termination) which is threaded into the ground terminal. Usually, the ground conductor insulation must be removed differently than the other conductors, inconveniencing the electrician, and the convenience of wire clamp termination cannot be utilized for wiring such ground terminals.

Accordingly, there is a need for a new and improved electrical cap and connector assembly capable of relatively simple and inexpensive fabrication; enabling speedy, secure and simple installation; and characterized by safe and durable construction.

It is therefore an object of the present invention to provide new and improved electrical connector apparatus. Another object of the invention is to provide a new and improved electrical connector apparatus capable of substantially speedy and simple installation.

It is also an object of the invention to provide a new and improved electrical connector apparatus characterized by dead front surfaces having no exposed metallic parts with the exception of the protruding plug prongs.

It is an additional object of the invention to provide a new and improved electrical connector apparatus which can be assembled by simply snapping together all major component parts.

It is yet another object of the invention to provide a new and improved electrical connector apparatus which eliminates the need for threaded fasteners for assembling the apparatus.

It is a further object of the present invention to provide a new and improved electrical connector apparatus having component parts, most of which can be fabricated from a moldable plastic material.

It is still another object of the invention to provide new and improved connector apparatus which can be simply adapted for a wide range of multi-conductor cables and a wide range of amperage ratings.

It is also another object of the present invention to provide a new and improved electrical connector means which enables fast and simple wiring of the ground conductor in connectors having a centrally located ground terminal.

Objects and advantages of the invention are set forth in part herein and in part will be apparent herefrom, or may be learned by practice with the invention, the same being realized and attained by means of the structures, instrumentalities and combinations pointed out in the appended claims. Accordingly, the invention resides in the novel parts, structures, arrangements, combinations and improvements herein shown and described.

SUMMARY OF THE INVENTION

Briefly described, the improved connector apparatus according to the present invention includes a connector front adapted to provide access to electrical coupling means (i.e., a plug or a receptacle) and formed with a pair of generally oppositely disposed leg members, a terminal housing adapted to be releasably lockably fastened to the connector front for retaining the terminal portions of the electrical coupling means therebetween and providing access to the terminal portions for connection to the cable conductors, a generally hollow connector housing adapted to be attached to the connector body (made up of the assembled connector front and terminal housing) and means threadably engageable onto the connector housing for tighteningly engaging the cable to hold it in a fixed position in the housing and, thereby, relative to the connector body. Advantageously, and as here preferably embodied, the leg members are formed integrally with the connector front and include first engaging means for releasably lockably coupling the terminal housing to the connector front and second engaging means for releasably lockably coupling the assembled connector body to the connector housing.

As preferably embodied, the second engaging means comprises a sear member formed at the end of the leg member and the housing is formed with an aperture adapted to receive the sear in a ratchet-like manner and provide a lip for engagement by the sear for lockably coupling the connector body and the housing. Also as preferably embodied, the means for tighteningly engaging the cable includes a collar threadably engageable onto the housing with a chuck member positioned therebetween for tighteningly grasping the cable, and the chuck member is formed with extensions adapted to be positioned radially inwardly of and behind at least a portion of the sear formed on the leg, when the chuck is tightened onto the cable.

According to another aspect of the present invention, the connector body may be formed with a radially extending opening having a pair of surfaces extending into the opening, generally perpendicular to the radial direction, with one radially inward of the other. The opening is adapted to receive a screw which is at least as long as the connector body radius with the outer surface adapted to abut the radially inward surface of the head of the screw and the inner surface abutting the radially outward surface of a flange formed on the screw so that the screw is restrained from movement in radial direction and the end of the screw extends through the terminal plate of the ground terminal/contact and is threaded into a movable terminal plate so that threading the screw into the movable plate enables the plates to be tightened against each other.

It will be apparent from the foregoing general description that the objects of the invention as here embodied. Thus, it has been found that connector means made in accordance with the present invention are capable of quicker and easier assembly than caps and connectors heretofore known.

In addition, by constructing electrical caps and connectors in accordance with the present invention, it has been found that the component parts may be made in essentially one size, yet accommodate substantially all multi-conductor cables, for a wide range of amperage rating.

It has also been found that by providing a connector front formed with leg members having first and second engaging means, the electrical connector assembly can be assembled together without any metallic threaded fasteners except for those which may be used for wiring the cable conductors to the electrical terminals in the connector body.

In addition, by providing the opening in the connector body with the pair of surfaces as well as an elongate ground screw having a flange thereon, the ground conductor in the cable can be conveniently wired and prepared for wiring in essentially the same manner as the other conductors in the cable.

Furthermore, by constructing cap and connector apparatus according to the invention, the component parts may, with the exception of the electrical conducting and connecting elements, be made from a moldable plastic material.

It will be understood that the foregoing general description, as well as the following detailed description are exemplary and explanatory of the invention but are not intended to be restrictive thereof. Thus, the accompanying drawings, referred to herein and constituting a part hereof, illustrate preferred embodiments of the invention and, together with the detailed description, serve to explain the principles of the invention.

FIGS. *3a–c* are various sectional views showing the operative positions of preferred chuck means according to the invention.

FIG. *3d* is a view along Section *3d–3d* of FIG. *3c*.

FIGS. *4a* and *b* are section and plan views, respectively of a preferred connector housing according to the invention.

Figure 5:
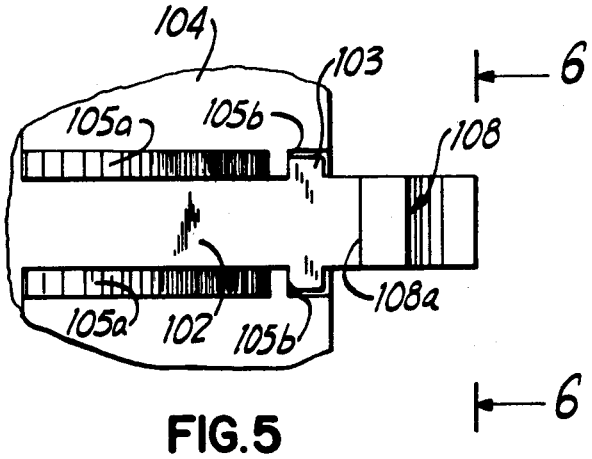

FIG. 5 is an enlarged plan view of a portion of a partially assembled connector assembly according to the invention, showing a leg member lockably engaged with the terminal housing by first engaging means formed on the leg.

Figure 6:
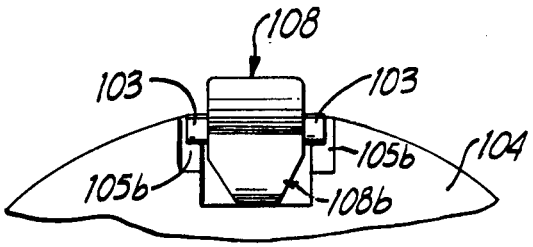

FIG. 6 is a view taken along lines 6—6 of FIG. 5.

Figure 7:
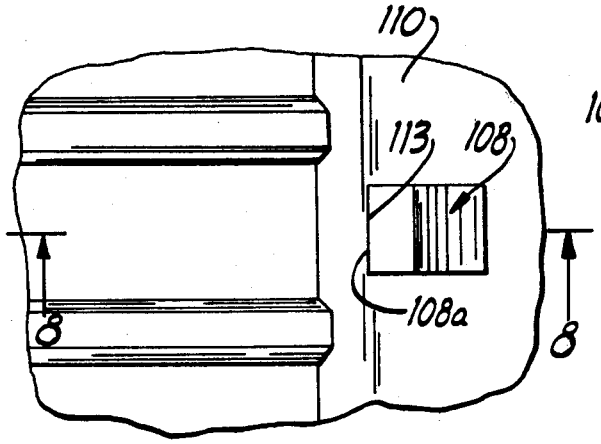

FIG. 7 is an enlarged view similar to FIG. 5 of the terminal housing, a leg member and the connector housing coupled together in accordance with the invention.

Figure 8:
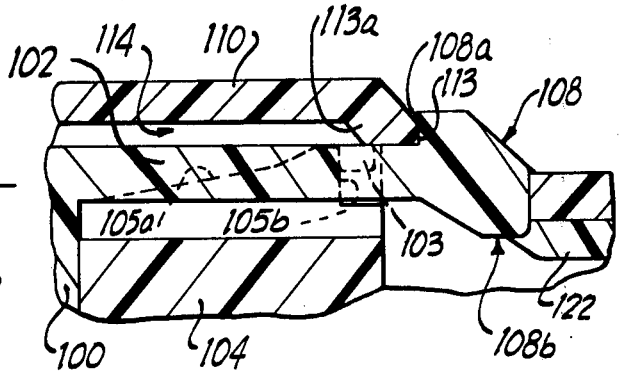

FIG. 8 is a view taken along section lines 8—8 of FIG. 7.

DETAILED DESCRIPTION OF PREFERRED EMBODIMENTS

Referring generally to the accompanying drawings, wherein like reference characters refer to like parts throughout the various views, there is shown a preferred embodiment illustrating the various aspects of the present invention. It will be understood that throughout the various figures described hereinafter, the same reference numbers will be used to identify th same or analogous component elements of both the male and female connector elements, since, except for the connector fronts, the present invention enables the use of identical component parts for both connector sections. Thus, the following description is intended to apply to both the male and female connector sections.

Figure 1:
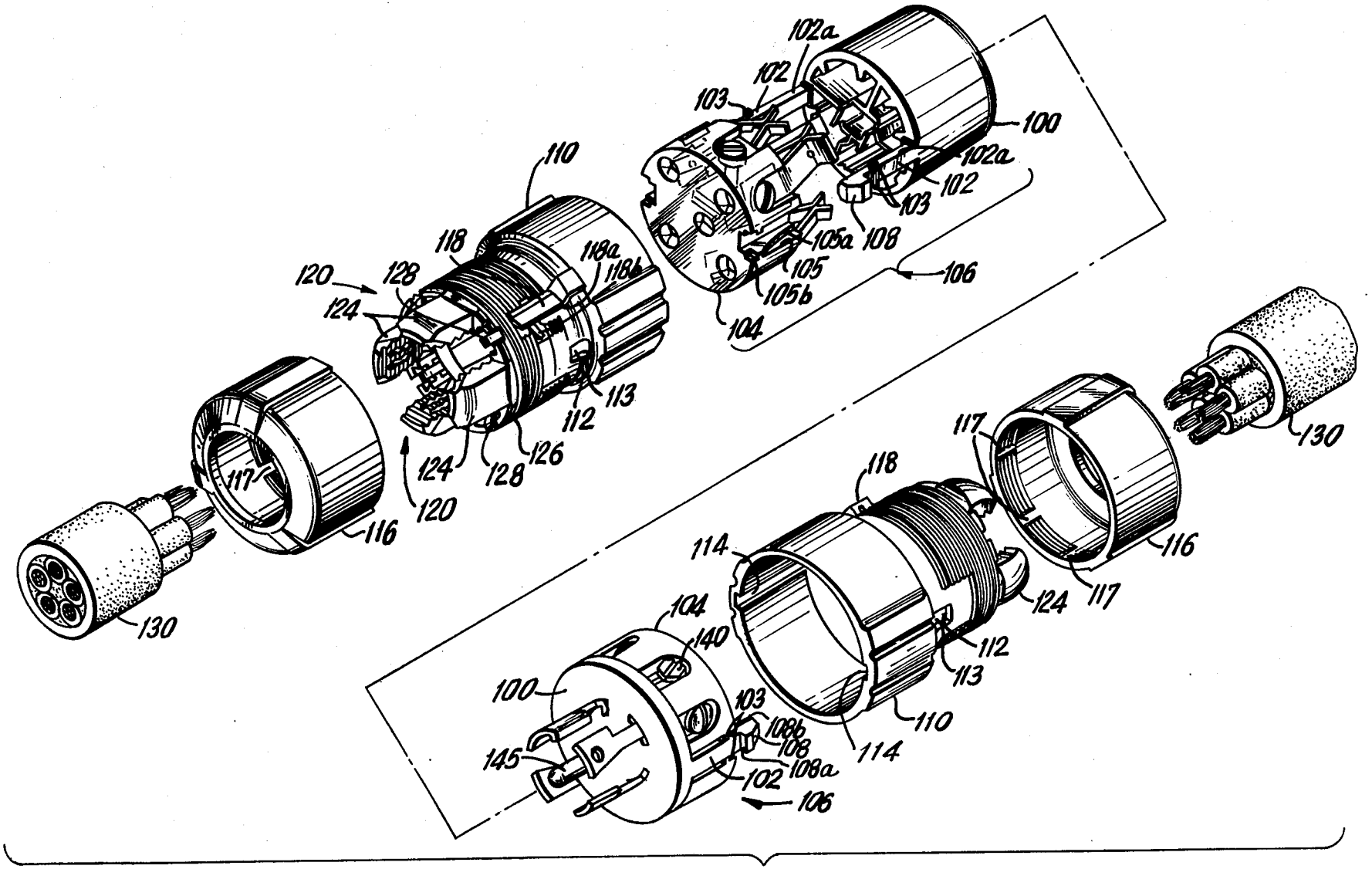
FIG. 1 is an exploded perspective view of a preferred embodiment according to the present invention.
Figure 2:
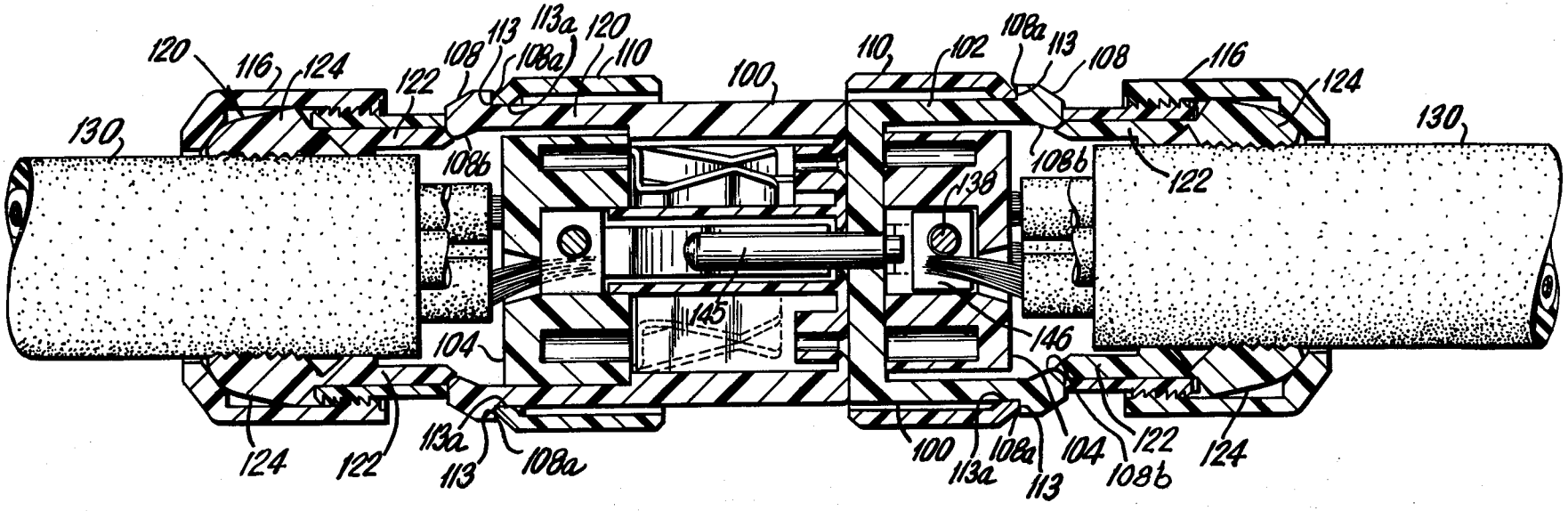
FIG. 2 is a section view of the embodiment in FIG. 1 in assembled and coupled configuration.
Figure 3A:
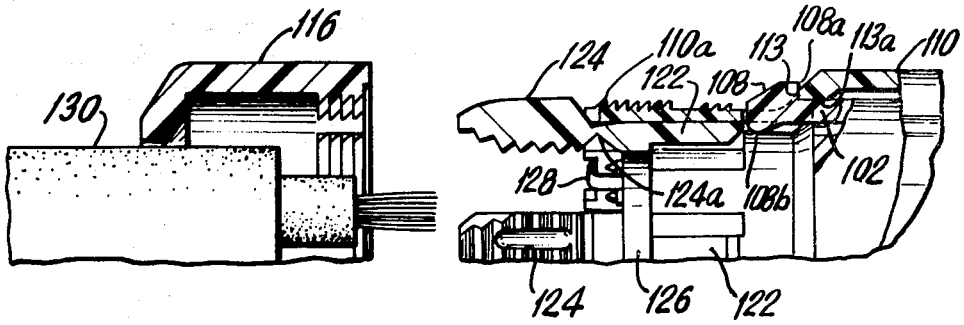
Figure 3B:
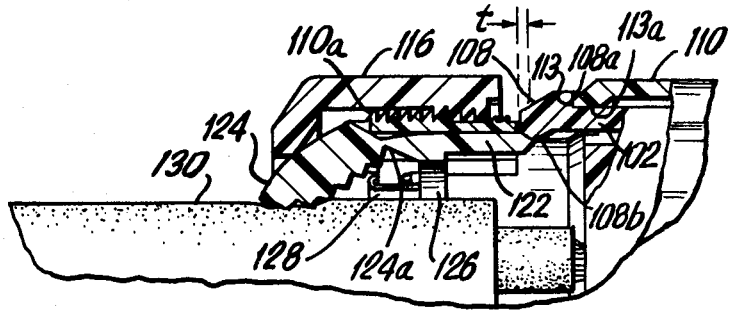

Referring now, more particularly to FIGS. 1 and 2 there are shown section views of the connector assembly in exploded and assembled/installed configurations, respectively. According to the embodiment illustrated in FIGS. 1 and 2, each connector member (i.e., the male member and the female member) is formed with connector body 106 (made up of connector front 100 and terminal housing 104), connector housing 110 and means for tighteningly engaging the electrical cable (indicated at 130), here in the form of collar 116 and chuck means 120. As preferably embodied, connector front 100 is formed with a pair of leg members 102 which are preferably formed integral with connector front 100 and extend rearwardly of its front face (i.e., the face adapted to abut the other electrical connector section) and parallel to the longitudinal axis of the assembled connector member.

According to one aspect of the invention, each leg 102 is formed with means for releasably lockable engaging terminal housing 104 to retain connector front 100 and terminal housing 104 assembled together and form connector body 106, with the terminal portions of either the male electrical plug elements or female electrical receptacle elements contained in terminal housing 104 and the electrical plug or receptacle portions suitably exposed by connector front 100 for coupling together (i.e. with the plug portions extending from the front surface of the male connector front and the receptacle portions housed in the female connector front which is formed with suitable slots adapted to permit access to the receptacle portions by the plug prongs). To this end, each leg 102 is formed with projections 103 extending perpendicularly outwardly therefrom in the circumferential direction of the assembled connector member from the edges of each leg 102 which have a dimension in the radial direction (indicated at 102*a*). In addition, terminal housing 104 is formed with a pair of slots 105, positioned for corresponding to and slidably receiving legs 102 for releasably locking legs 102 therein.

As previously embodied, each slot 105 is formed with a pair of ledges 105*a*, one on each of its side walls, for guiding projections 103 as legs 102 are slid into slots 105. Advantageously, ledges 105*a* are sloped in the radial direction, increasing in inclination, radially outwardly, in the direction of insertion of legs 102 into slots 105, and terminate to form an abutment surface behind the point of greatest slope. Also as preferably embodied, the end portion of sloped ledges 105*a* (i.e., the portion closest to the termination point) have a slightly greater slope than the front portion of ledges 105*a* to facilitate the ratchet-like action described below. Moreover, ledges 105*a* preferably terminate at the outer surface of the terminal housings and form a small part of the outer surface (as evident from FIG. 1), to provide a broad abutment surface 105*b*, extending in the radial direction, for engagement by projections 103.

Thus, as connector front 100 and terminal housing 104 are brought together for assembly to form connector body 106, legs 102 are inserted into slots 105 and projections 103 ride along ledges 105*a* and cause legs 102 to be increasingly spread apart until the point of maximum slope of ledges 105*a*, whereafter projections 103 snap radially inwardly, in a generally ratchet-like manner, to bear against abutment surfaces 105*b* (See FIGS. 5 and 6). In this way, separation of connector front 100 and terminal housing 104 is prevented by projections 103 bearing against abutment surfaces 105*b*. Moreover, assembly of conductor body 106 may thereby be accomplished in a simple single-step operation, without the need for screws or other metallic and/or threaded fasteners.

Also according to the invention, each leg 102 is additionally formed with means for releasably lockably engaging connector housing 110. To this end, the free end of each leg 102 is formed with sear means 108 adapted to releasably lockably engage lip means, preferably provided at edge 113 of aperture 112, which are formed in connector housing 110. Advantageously, lip means 113 include projection 113*a* (see, e.g., FIG. 2) extending radially inwardly from the interior surface of housing 110 to provide additional structural strength behind lip 113 for withstanding the bearing force transmitted by the engaging surface (indicated at 108*a*) of sear means 108 when any attempt is made to pull apart the assembled connector body and connector housing. In addition, both the leading edge of sear 108 and the back edge of projection 113*a* are formed with reciprocally sloping surfaces to facilitate passage of sear 108 over projection 113*a* during insertion of legs 102 into housing 110. Further advantageously, and as preferably embodied, projection 113*a* may be formed simply by providing groove 114 in the interior surface wall of housing 110. In this way, sear 108 can be guided by groove 114 as legs 102 are inserted into housing 110.

Accordingly, after connector body 106 is assembled, it may be releasably locked within connector housing 110 simply by inserting legs 102 into housing 110 with sears 108 deflecting radially inwardly as they ride over projection 113*a* and snapping back, radially outwardly, in a ratchet-like fashion to lockably engage lip 113 (See FIGS. 7 and 8) once surface 108*a* has passed lip 113. In addition, since the free ends of legs 102 are "squeezed" together in the radially inward direction as sear 108 rides over projection 113*a*, there is no risk that such action will cause disassembly of connector body 106 (i.e., disassembly of connector front 100 from terminal housing 104) because projections 103 will also be moved radially inwardly and, therefore, will not be moved out of its abutting relation with surface 105*b*. Moreover, with the outward portions of sears 108 exposed through apertures 112, connector body 106 can be removed from housing 110 (e.g., for checking conductor connections to the terminals), simply by pushing the diametrically opposed sears 108 radially inwardly beyond lips 113 and withdrawing body 106.

Similarly, in order to disassemble connector body 106, legs 102 are simply spread radially outwardly apart until projections 103 are positioned radially outwardly beyond the radially outermost portion of surface 105*b* and separating connector front 100 and terminal housing 104. In this context, it is preferred that projections 103 do not extend the full thickness of legs 102 (see FIG. 1) so that the legs are not over-stressed when spread apart during assembly or disassembly.

Thus, it will be found that the double acting fastening means according to the present invention not only provide dead front surfaces on the connector front members, but they also obviate the need for screws or other metallic fasteners for retaining any of the component parts in assembled configuration. In addition, the coupling between connector body 106 and connector housing 110 is capable of withstanding substantial "pulling" forces before separating because of the relatively large abutting surface areas of surfaces 108*a* and 113 and the integral nature of legs 102 and connector front 100.

As indicated above, the means for tighteningly grasping cable 130 to the connector assembly includes collar 116 which is threadably engageable into the end of housing 110 opposite that to which conductor body 106 is attached, with chuck means 120 positiond therebetween, adapted to tighteningly grasp cable 130 as collar 116 is threaded onto housing 110. Advantageously, and as here preferably embodied, means are provided for realeasably locking collar 116 on housing 110, such as disclosed and claimed in U.S. patent application Ser. No. 679,785, filed Apr. 23, 1976, now U.S. Pat. No. 4,053,198, granted Oct. 11, 1977, assigned to the same assignee as the present application which is hereby incorporated by reference herein. Thus, collar 116 may be formed with slots 117 and housing 110 may be provided with shaft/detent member 118 rotatably mounted in a suitable recess formed in housing 110 with biasing flange 118*b* abutting a suitable structure in housing 110. In addition, since the connector means according to the present invention may be adapted for relatively large cables, the detent flange (indicated at 118*a*) may be relatively long to ensure firm bearing within slots 117.

As preferably embodied, chuck means 120 are formed with extensions 122 extending oppositely from cable engaging portions 124. According to the invention, extensions 122 are adapted to be positioned behind sear means 108 when connector body 106 and housing 110 are assembled and after the chuck means are tightened on the cable, (explained more fully below) to prevent inadvertent disassembly of body 106 and housing 110 when the cable is wired to the connector assembly. Such inadvertent disassembly could otherwise occur, for example, when the wired male and female connectors are firmly grasped to be pulled apart for breaking the electrical connection between two cables; sears 108 could accidently be forced radially inwardly an amount sufficient to become free of lips 113.

Figure 3C:
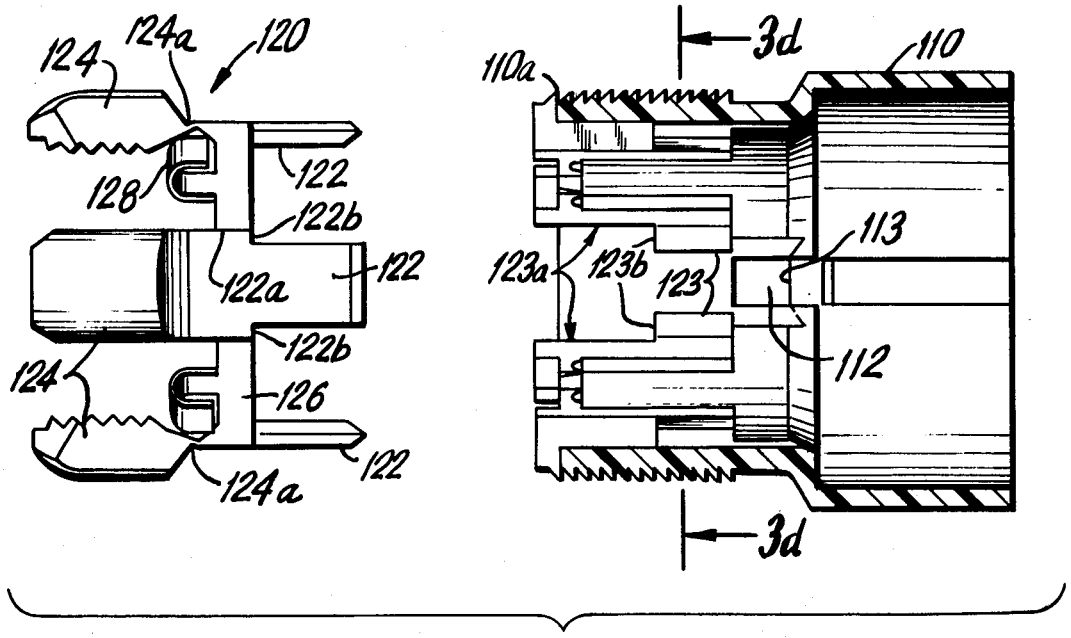
Figure 3D:
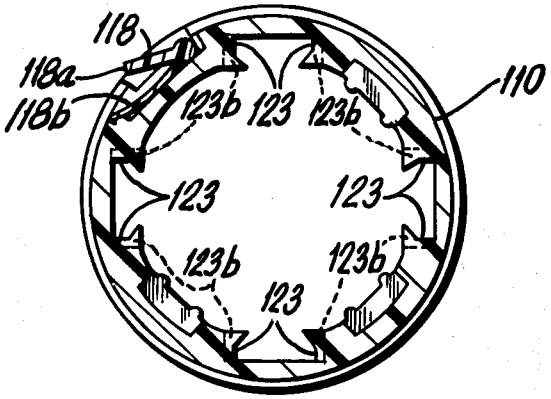

To this end, chuck means 120 are adapted to tighteningly grasp cable 130 as collar 116 is threaded onto housing 110 and to position extensions 122 behind sear means 108 when the collar/chuck means have fully grasped cable 130. In addition, chuck means 120 are preferably adapted to retract extensions 122 from behind sear means 108 when collar 116 is reverse threaded to loosen cable 130. Accordingly, chuck means 120 is preferably integrally formed of a generally flexible and resilient material such as type-6 Nylon and includes four chuck elements (or cable-grasping portions) 124 which are coupled to extensions 122 by relatively thin hinge portions (indicated at 124*a*), with extensions 122 coupled together in a generally symmetrical configuration by band 126. As preferably embodied, the principal portions (elements 124 and extensions 122) of chuck means 120 are adapted to slide in housing 110. To this end, extensions 122 are positioned within circumferentially undercut slots 123 (FIG. 3*d*) adapted to permit slidable movement of extensions 122 therewithin in the longitudinal direction of the assembled connector assembly but to prevent movement in the radial and circumferential directions. As can be seen from FIG. 3*c*, slots 123 preferably extend at least to about the edge of aperture 112 for providing support on the radially inward surface of extensions 122 to effectively reinforce them when they are located behind sears 108 to prevent radially inward movement thereof, regardless of the thickness of cable 130.

Advantageously, in order to retract extensions 122 from behind sears 108 when disassembly is desired, chuck means 120 are formed with biasing means in the form of resilient hook-like members 128 adapted to bear against edge 110*a* of housing 110. As preferably embodied, the free end of each hook-like member 128 is located in a recess 110*b* formed in edge 110*a* to ensure members 128 are held in position to function as intended. Also advantageously, each slot 123 is formed with enlarged portion 123*a* to form corner-like abutment surface 123*b* and each extension 122 is formed with enlarged portion 122*a* proportioned to fit within enlarged slot 123*a* and forming abutment surface 122*b* adapted to bear against surface 123*b* when the free ends of extensions 122 have moved a sufficient amount behind sears 108 for preventing radially inward movement thereof. Thus, the travel of extensions 122 needed to ensure firm bearing behind sears 108 can be kept relatively small. Thus, it has been found that a travel (t) adapted to provide engagement of about 0.090" of extensions 122 onto the radially inward surface of legs 102 is sufficient to prevent inadvertent depression of sears 108.

In operation, as collar 116 is tightened onto housing 110, chuck elements 124 are first moved slightly longitudinally in the direction of threading, until the back surfaces 122*b* of chuck means 120 abut surfaces 123*b* of housing 110, with extensions 122 simultaneously moved in the same direction whereby the free ends of extensions 122 are moved behind sear means 108 until located in the predetermined seating behind sears 108 when surface 122*b* abuts surface 123*b*. Generally after extensions 122 have been fully seated behind sears 108, further threading of collar 116 onto housing 110 urges the free ends of chuck elements 124 radially inwardly for tighteningly grasping cable 130. Once the desired grasping is achieved, collar 116 is releasably locked in that position by flange 118*a* wedging into a slot 117.

When disassembly is desired, detent/shaft 118 is deflected radially inwardly to remove flange 118*a* from within the slot 117. Thereafter, collar 116 can be unthreaded from housing 110. As collar 116 is unthreaded, chuck elements 124 are loosened from cable 130 and hook-like biasing members 128 cause extensions 122 to be withdrawn from behind sears 108, enabling connector body 106 and housing 110 to be separated as described above.

Advantageously, sears 108 may be formed with radially inwardly projecting protuberances 108*b* adapted to firmly bear against extensions 122. Also advantageously, the free end edge of extensions 122 are beveled to facilitate riding behind protuberances 108*b*.

It will be readily appreciated from the foregoing that the connector assembly according to the present invention enables the use of universal parts in either the male or female connector members. Thus, the terminal housings (104), the connector housings (110), the collars (116) and the chuck means (120) may be essentially identical for both male and female connector members, as well as for various size cables. Virtually the only differences reside in the connector fronts. The male connector front resembles a generally flat disc with legs 102 extending therefrom and slots to permit the prongs of the male plug contacts to extend therethrough for insertion into the female member. The female member is a generally cylindrical member with legs 102 extending opposite its front face and having suitably formed recesses to hold the receptacle contacts, as well as slots at its front face to enable insertion of the plug prongs for engagement in the receptacle contacts. Moreover, the front surface of the male connector front is essentially flush with the front edge of housing 110, whereas the chamber in the female connector front, which houses the receptacle terminals, extends beyond the front edge of its connector housing, as shown in FIG. 8, such that legs 102 are the same length for both male and female front members to enable use of the same connector housing and terminal housing for both male and female connector members.

Connection between the conductors in cable 130 and the various contacts in the connector members (i.e., termination of the conductors) is preferably carried out by wire clamp termination. To this end, terminal housing 104 is formed with a plurality of chambers 150 having a slightly enlarged slot portion adapted to hold contact/terminal plate 152*a* into which is inserted screw 154 which, in turn, is threaded into contact/terminal plate 152*b* for moving plate 152*b* relative to plage 152*a*, with opening 148 formed in the side of housing 104 adapted to face cable 130 for communicating such side with chambers 150 to permit insertion of a conductor into recess 150. In addition, resilient material 156 is positioned within each chamber 150 for urging plates 152*a* and 152*b* towards each other for initially grasping the conductor when inserted through opening 148 and into the space between plates 152*a* and 152*b* and also for facilitating threading of screw 154 into plate 152*b* in the event they become unthreaded.

It will be understood that once the conductor is positioned between plates 152*a* and 152*b*, screw 154 is threaded into plate 152*b* (with the head of screw 154 bearing against plate 152*a*) to firmly grasp the conductor. It will also be understood that one of plates 152*a* and 152*b* (preferably stationary plate 152*a*) is coupled to or forms part of the electrical contact (i.e., the plug prong or the receptacle contact).

Advantageously, opening 148 is tapered in the direction of insertion of the conductor to facilitate insertion into chamber 150. As preferably embodied, such tapering is adapted to form a generally rectangular window at the end of opening 148 which opens into chamber 150. In this way, the wire elements of each conductor will be apread (or flattened) slightly to facilitate insertion between plates 152*a* and 152*b*.

Advantageously, the terminal portions of the male electrical contacts may be formed at one end of a strip of metal whose other end is proportional to form the blades (or prongs) of the male connector, simply by dimensioning that end to fit within the slot formed in chamber 150 and forming an aperture for permitting insertion of screw 154. The terminal portions of the female electrical contacts may be formed simply by folding a strip of metal over itself, with its free ends proportioned in the desired configuration for releasably grasping the male plug blades, and forming an aperture in the folded end for permitting insertion of screw 154, so the folded end can be inserted in the slot formed in chamber 150. It will be understood that since the material making up the male contacts is generally thicker than that of the female contacts (as the male contacts must withstand axial forces caused by insertion into the female receptacles) the female contacts can be formed so that the thickness of the folded over end is equal to about that of the male contact for fitting in the slots formed in chamber 150, thereby enabling use of identical terminal housings 104 for both male and female connector sections.

Figure 4A:
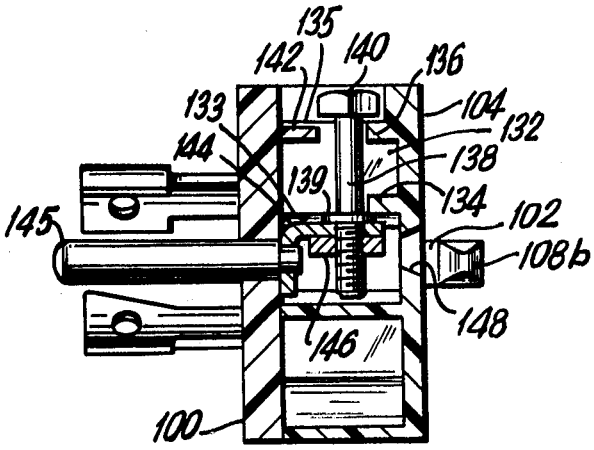
Figure 4B:
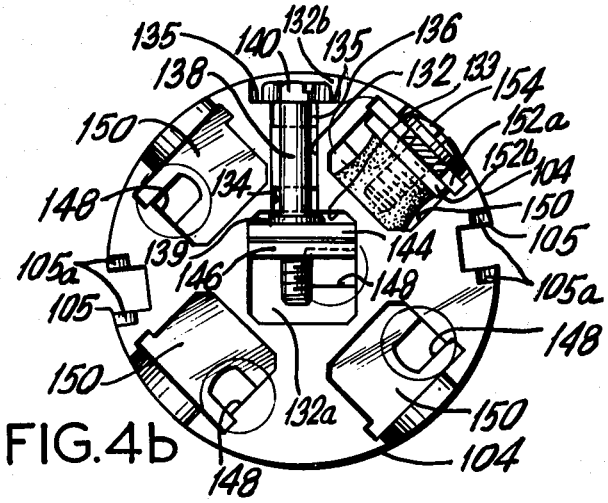

Turning now to FIGS. 4*a–b*, there is shown another aspect of the present invention which enables the use of wire clamp termination for wiring the ground conductor of cable 130 to the ground terminal in connector assemblies wherein the ground terminal is located in the center of the conductor front member, such as in a five-conductor cable connector. According to this aspect of the invention, terminal housing 104 is formed with slot 132 extending radially inwardly of housing 104 and including enlarged portion 132*a* located generally central of housing 104 (to hold the wire clamping terminal portions 144 and 146 of the ground contact) and enlarged portion 132*b* located at the radially outward end of slot 132 to communicate slot 132 with the ambient surroundings. Thus, as shown in FIG. 4*b*, enlarged portion 132*a* defines radially inwardly facing surface 135 and enlarged portion 132*b* defines radially outwardly facing surface 133. In addition, ground termination screw 138 is formed not only with head 140, but also circular flange portion 139 generally near its threaded portion.

Therefore, according to this aspect of the invention, ground termination screw 138 may be retained generally in position by inserting it into slot 132 with the inside surface of head 140 abutting surface 135 and the radially outwardly facing surface of flange 139 abutting surface 133.

As preferably embodied, terminal housing 104 is also formed with flange 136 and flange 134 to form continuations of surfaces 135 and 133, respectively, to provide additional surface areas against which the radially inward surface of head 140 and the radially outward surface of flange 139, respectively, can bear. In addition, connector front 100 is advantageously formed with flange 142 adapted to project toward screw 138 from the opposite side thereof as flange 136 to ensure screw 138 remains in position. In this way, connection of the ground conductor in cable 130 to the ground contact in the connector member (in both plug and receptacle members) can be carried out by essentially the same wire clamp termination method as the other conductor terminations rather than wrapping the ground conductor around the ground screw (i.e. by binding screw termination), where the ground contacts are located generally centrally of the connector front members 100.

To this end, enlarged portion 132*a* is a box-like chamber which is open on the side of housing 104 adapted to face connector front 100 for receiving the termination portion of the ground contact. In addition, screw 138 is inserted into an aperture (not shown) formed in plate/-contact element 144, dimensioned between the diameter of screw 138 and that of flange 139 for enabling slidable insertion of screw 138 thereinto but preventing insertion beyond flange 139, and screw 138 is threaded into plate/contact element 146, formed with an aperture suitably dimensioned to accommodate such threading. One of plates 144 and 146, preferably plate 146 since it can remain essentially stationary relative to screw 138, forms the terminal portion of ground contact 145 (whether a plug prong or a receptacle contact).

Thus, similar to the termination of the other contacts described above, screw 138 is unthreaded to separate plate members 144 and 146. The ground conductor is thence inserted through aperture 148 which communicates chamber 132*a* with the other side of housing 104 (i.e., the side opposite that adapted to abut connector front 100) and into the space between plates 144 and 146. Thereafter, screw 138 is threaded into plate 146 to bring plates 144 and 146 together for retaining the ground conductor therebetween and making secure electrical connection between the ground conductor and ground terminal 145.

It will be understood by those skilled in the art that connector front 100, terminal housing 104, connector housing 110, collar 116 and chuck 120 can all be molded from an injection moldable plastic material. Moreover, the component parts are universal in that they can be proportioned so that one size can be adapted to be wired to virtually any sized cable. In addition, and specifically with respect to terminal housing 104, the mold can be provided with inserts for preventing formation of one or more terminal containing recess, such as, for example, for a four-conductor connector, an insert can be applied to the mold to prevent formation of slot 132 so that only four functional terminal recesses (indicated at 150 in FIG. 4*b*, with exemplary wire clamp terminal plates and screws indicated in phantom at 152*a*/152*b* and 154, respectively, are contained in terminal housing 104.

It will readily be appreciated by those skilled in the art that the invention in its broader aspects are not limited to the specific embodiments herein shown and described. Rather, variations may be made therefrom within the scope of the accompanying claims, without departing from the principles of the invention and without sacrificing its chief advantage.

What is claimed is:

1. Connector means adapted to be coupled to the electrical conductors in an insulated electrical cable, comprising:

a terminal housing adapted to support electrical contact means and to electrically isolate terminal portions of said electrical contact means yet enable access thereto for coupling the conductors to said terminal portions of said electrical contact means;

a connector front member adapted to be releasably lockably attached on one side to one side of said terminal housing member, said connector front member being adapted to permit access to contact portions of said electrical contact means on its other side, said terminal housing and said connector front member forming a connector body when coupled together;

at least two generally flexible and resilient leg members formed on said connector front member, extending in a direction longitudinally back from its said other side, each said leg member formed with first engaging means adapted to releasably lockably couple said connector front member and said terminal housing together to form said connector body, and each said leg member also being formed with second engaging means;

a generally cylindrical connector housing member, said connector housing member adapted to receive said connector body and the cable when coupled to said terminal housing, said connector housing adapted to be releasably lockably attached to said connector body by said second engaging means; and means associated with said connector housing for tighteningly grasping the cable when the conductors are coupled to said terminal portions to retain the cable fixed relative to said connector housing; such that said terminal housing, said connector front member and said connector housing can be retained in assembled configuration by said first and second engaging means without threaded fasteners.

2. Connector means according to claim 1 wherein said leg members and said first and second engaging means are formed integrally with said connector front member.

3. Connector means according to claim 2 wherein said terminal housing is formed with first abutment means adapted to be engaged by said first engaging means and wherein said first engaging means comprise first latching means adapted to abut said first abutment means when said terminal housing is releasably lockably coupled to said connector front member, such that when said first latching means are located in abutting relation with said first abutment means, disengagement of said terminal housing from said connector front is substantially prevented.

4. Connector means according to claim 3 wherein said connector housing is formed with second abutment means adapted to be engaged by said second coupling means and wherein said second engaging means comprise second latching means adapted to abut said second abutment means when said connector body is lockably coupled to said connector housing, such that when said second latching means are located in abutting relation with said second abutment means, disengagement of said connector housing from said connector body is substantially prevented.

5. Connector means according to claim 3 wherein said first latching means comprise a pair of projections extending outwardly from the longitudinally extending side edges of said leg member, and wherein said terminal housing is formed with a pair of slots positioned therein to slidably receive said leg members during assembly of said connector body, each said slot formed with a pair of radially outwardly sloping ledge portions on its longitudinally extending side walls, each said sloped ledge portion terminating to form an abutment surface extending generally perpendicular to said slot at the back end of each ledge, such that as said terminal housing and said connector front member are being coupled together, said leg members are generally slidably received in said slots and said projections ride along said ledge portions to force said legs members radially outwardly apart until said projections resiliently snap radially inwardly generally in a ratchet-like manner, behind said abutment surfaces, whereby said projections bear against said abutment surfaces to prevent separation of said terminal housing and said connector front member.

6. Connector means according to claim 5 wherein said ledges slope radially outwardly towards the outer surface of said terminal housing before terminating at said first abutment means.

7. Connector means according to claim 5 wherein the free end of each leg member is formed with sear means extending radially outwardly therefrom and wherein said connector housing is formed with lip means positioned to correspond to each said sear means such that as said connector body and said connector housing are being coupled together, said sear means and said lip means are coupled in a generally ratchet-like manner, whereby said engaged sear and lip means prevent separation of said connector body and said connector housing.

8. Connector means according to claim 7 wherein said lip means are provided by apertures formed in said connector housing, said apertures adapted to expose a portion of said sear means when said connector body and said connector housing are coupled together such that when separation of said connector body and said connector housing is desired, said sear means can be pushed radially inwardly past said lip means to disengage said sear means from said lip means and permit separation of said connector body and said connector housing.

9. Connector means according to claim 8 wherein said cable-securing means comprise a collar member adapted for threadable engagement with said connector housing and chuck means, said chuck means being positioned between said collar and said housing and being adapted to tighteningly grasp the cable as said collar means are threaded onto said connector housing, said chuck means including a number of extension members at least equal to that of said leg members, said extension members adapted to project at least partially behind the free ends of said leg members on the radially inward side thereof when said chuck means have tighteningly grasped the cable, such that radially inward depression of said sear means is substantially resisted by said extension members to substantially prevent inadvertent disassembly of said connector body and said connector housing.

10. Connector means according to claim 9 which further includes a generally wedge-shaped protuberance formed on the radially inward surface of the free end of each said leg member to abut said extension members when positioned therebehind.

11. Connector means according to claim 10 wherein said connector front, said leg member, said projections, said sear means and said protuberances are integrally formed from a moldable plastic material.

12. Connector means according to claim 1 which further includes a relatively elongate terminal screw, said screw having a threaded portion generally at one end and a head at its other end and having a flange between its two ends; wherein said terminal housing is formed with a chamber interior thereof, adapted to support and electrically isolate the terminal portion of an additional electrical contact means, said additional contact terminal portion including a fixed terminal plate affixed to the contact portion of said additional contact means and a movable terminal plate, and wherein said terminal housing is also formed with a slot extending generally radially outwardly to the exterior surface of said terminal housing to provide access to said chamber, said slot having a first surface generally near the radially outermost end of said slot, said first surface adapted to abut the radially inward surface of said screw head, and a second surface radially inward of said first surface, said second surface adapted to abut the radially outward surface of said screw flange, such that the threaded end of said screw can be freely inserted through an unthreaded borehole formed in the said terminal plate and threaded into a threaded borehole formed in said movable terminal plate for bringing the terminal plates together to enabling wire clamp termination of a conductor in the cable to said additional electrical contact means.

13. Connector means according to claim 12 wherein said additional electrical contact means is the ground contact of said connector means and is located generally at the center of the front face of said connector front and wherein the conductor wired thereto is the ground conductor, such that the ground conductor can be simply wired to the ground contact.

14. An electrical connector assembly for coupling the conductors of two insulated electrical cables, comprising:

a first terminal housing adapted to support male electrical contact means and to electrically isolate terminal portions of said male electrical contact means yet enable access to said male terminal portions for coupling to the conductors of one cable;

a first connector front member adapted to be releasably lockably coupled on one side to one side of said first terminal housing member, said first terminal housing and said first connector front member forming a male connector body when coupled together, said first connector front member adapted to expose blade portions of said male electrical contact means on its other side, and said first connector front member formed with at least two generally flexible and resilient leg members extending longitudinally back from its said other side, each said leg member being formed with first engaging means adapted to releasably lockably couple said first connector front member to said male terminal housing together to form said male connector body, and each said leg member also being formed with second engaging means;

a second terminal housing adapted to support female electrical contact means and to electrically isolate terminal portions of said female electrical contact means yet enable access to said female terminal portion for coupling to the conductors of the other cable;

a second connector front member adapted to be releasably lockably attached on one side to one side of said second terminal housing, said second terminal housing and said second connector front member forming a female connector body when coupled together, the other side of said second connector front being adapted to permit engagement between receptacle portions of said female contact means and said male contact blades, and said second connector front member formed with at least two generally flexible and resilient leg members extending longitudinally back from its said other side, each said leg member being formed with first engaging means adapted to releasably lockably couple said second connector front member and said second terminal housing together to form said female connector body, and each said leg member also being formed with second engaging means;

two generally cylindrical connector housing members, each adapted for receiving the end of one cable and one of said male and female connector bodies, each said connector housing adapted to be releasably lockably engaged by said second engaging means formed on the leg members of the connector body releasably attached thereto for releasably lockably securing the connector body to one said connector housing; and means associated with each said connector housing for tighteningly grasping a cable when coupled to said one connector body to retain the cable fixed relative to the connector housing, such that said first terminal housing, said first connector front member and one said connector housing can be assembled into a male connector member with its said grasping means associated therewith without threaded fasteners, and said second terminal housing, said second connector front member and the other said connector housing can be assembled into a female connector member with its said grasping means associated therewith without threaded fasteners.

15. An electrical conductor assembly according to claim 14 wherein said leg members and said first and second engaging means are formed integrally with their said connector front members.

16. An electrical connector assembly according to claim 15, wherein each said terminal housing is formed with first abutment means adapted to be engaged by said first engaging means and wherein said first engaging means on each said leg member comprise first latching means adapted to abut said first abutment means when said terminal housing is releasably lockably coupled to its corresponding connector front members, such that when said first latching means are located in abutting relation with said first abutment means, disengagement of the terminal housing from its corresponding connector front member is substantially prevented.

17. A connector assembly according to claim 16 wherein each said connector housing is formed with second abutment means adapted to be engaged by said second engaging means and wherein said second engaging means on each said connector housing comprise second latching means adapted to abut said second abutment means when each said connector body is lockably coupled to its corresponding connector housing, such that when said second latching means are located in abutting relation with said second abutment means, disengagement of said connector housing from its corresponding connector body is substantially prevented.

18. A connector assembly according to claim 16 wherein said first latching means comprise a pair of projections extending outwardly from the longitudinally extending side walls of each said leg member, and wherein each said terminal housing is formed with a pair of slots positioned therein to slidably receive said leg members during assembly of said connector body, each said slot formed with a pair of radially outwardly sloping ledge portions on its longitudinally extending side walls, each said sloped ledge portion terminating to form an abutment surface extending generally perpendicular to said slot at the back end of each ledge, such that as each said terminal housing and its corresponding connector front member are being attached, said leg members are generally slidably received in said slots and said projections ride along said ledge portions to force said leg members radially outwardly apart until said projections resiliently snap radially inwardly generally in a ratchetlike manner, behind said abutment surfaces, whereby said projections bear against said abutment surfaces to prevent separation of said terminal housing and said connector front member.

19. A connector assembly according to claim 18 wherein said ledges slope radially outwardly towards the outer surface of each said terminal housing before terminating at said first abutment means.

20. A connector assembly according to claim 18 wherein the free end of each leg member is formed with sear means extending radially outwardly therefrom and wherein each said connector housing is formed with lip means positioned to correspond to each said sear means such that as each said connector body and its corresponding connector housing are being coupled together, said sear means and said lip means are coupled in a generally ratchet-like manner, whereby said engaged sear and lip means prevent separation of each said connector body and its corresponding connector housing.

21. A connector assembly according to claim 20 wherein said lip means are provided by apertures formed in each said connector housing, said apertures being adapted to expose a portion of said sear means when each said connector body and its corresponding connector housing are coupled together such that when separation of the connector body from its corresponding connector housing is desired, said sear means can be pushed radially inwardly past said lip means to disengage said sear means from said lip means and permit separation of each said connector body and its corresponding connector housing.

22. A connector assembly according to claim 21 wherein said cable-securing means for each connector member comprise a collar member adapted for threadable engagement with each said connector housing and chuck means, said chuck means being positioned between said collar and said housing and being adapted to tighteningly grasp a cable as said collar means are threaded onto said connector housing, said chuck means including a number of extension members at least equal to that of said leg members, said extension members adapted to project at least partially behind the free ends of said leg members on the radially inward side thereof when said chuck means have tighteningly grasped the cable, such that radially inward depression of said sear means is substantially resisted by said extension members to substantially prevent inadvertent disassembly of each said connector body and its corresponding connector housing.

23. A connector assembly according to claim 22 which further includes a generally wedge-shaped protuberance formed on the radially inward surface of the free end of each said leg member to abut said extension members when positioned therebehind.

24. A connector assembly according to claim 23 wherein each said connector front, its said leg members, its said projections, its said sear means and its said protuberances are integrally formed from a moldable plastic material.

* * * * *